US008074611B2

(12) United States Patent
Schell et al.

(10) Patent No.: US 8,074,611 B2
(45) Date of Patent: Dec. 13, 2011

(54) THERMOSTAT ASSEMBLY HAVING INTEGRAL CYLINDER HEAD AND THERMOSTAT HOUSING

(75) Inventors: William L. Schell, Morton, IL (US); Paul F. Olsen, Chillicothe, IL (US); Michael P. Harmon, Dunlap, IL (US); Geary W. Smith, Jr., Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 483 days.

(21) Appl. No.: 12/232,948

(22) Filed: Sep. 26, 2008

(65) Prior Publication Data

US 2009/0084331 A1 Apr. 2, 2009

Related U.S. Application Data

(60) Provisional application No. 60/960,401, filed on Sep. 28, 2007.

(51) Int. Cl.
*F01P 7/02* (2006.01)

(52) U.S. Cl. ..... 123/41.1; 123/41.08

(58) Field of Classification Search ..... 123/41.08–41.1
See application file for complete search history.

(56) References Cited

U.S. PATENT DOCUMENTS

| | | | | | |
|---|---|---|---|---|---|
| 2,741,231 | A | * | 4/1956 | Watkins | 123/41.08 |
| 3,667,431 | A | * | 6/1972 | Kueny et al. | 123/41.08 |
| 3,939,807 | A | * | 2/1976 | Eichinger | 123/41.08 |
| 4,011,988 | A | | 3/1977 | Inagaki | |
| 4,052,965 | A | | 10/1977 | Morris | |
| 4,358,051 | A | | 11/1982 | Hunt | |
| 4,520,767 | A | | 6/1985 | Roettgen et al. | |
| 5,170,752 | A | * | 12/1992 | Binversie et al. | 123/41.08 |
| 5,515,815 | A | | 5/1996 | Phillips | |
| 5,803,050 | A | | 9/1998 | Osakabe et al. | |
| 6,446,586 | B2 | | 9/2002 | Fukamachi | |
| 6,530,356 | B2 | | 3/2003 | Inoue et al. | |
| 6,959,687 | B2 | * | 11/2005 | Iizuka et al. | 123/310 |
| 7,172,135 | B2 | | 2/2007 | Masuko et al. | |
| 2005/0120982 | A1 | | 6/2005 | Ducu | |

FOREIGN PATENT DOCUMENTS

| | | | | |
|---|---|---|---|---|
| EP | 1 195 504 | B1 | | 12/2006 |
| GB | 1388945 | A | * | 3/1975 |
| JP | 2001107729 | A | * | 4/2001 |

* cited by examiner

*Primary Examiner* — Noah Kamen
(74) *Attorney, Agent, or Firm* — Finnegan, Henderson, Farabow, Garrett & Dunner LLP

(57) ABSTRACT

A thermostat assembly for a combustion engine having at least one cylinder is disclosed. The assembly has a cylinder head configured to cap off the at least one cylinder, the cylinder head having a recess fluidly connected to a coolant passage of the combustion engine. The assembly also has a thermostat located completely within the recess.

23 Claims, 2 Drawing Sheets

THERMOSTAT ASSEMBLY HAVING INTEGRAL CYLINDER HEAD AND THERMOSTAT HOUSING

This application claims the benefit of U.S. Provisional patent application Ser. No. 60/960,401, filed Sep. 28, 2007.

TECHNICAL FIELD

This disclosure is directed to a thermostat assembly and, more particularly, to a thermostat assembly having an integral cylinder head and thermostat housing.

BACKGROUND

An internal combustion engine generally includes one or more combustion chambers that house a combustion process to produce mechanical work and a flow of exhaust. Each combustion chamber is formed from a cylinder, the top surface of a piston, and the bottom surface of a cylinder head. Air or an air/fuel mixture is directed into the combustion chamber by way of intake ports disposed in the cylinder head, and the resulting exhaust flow is discharged from the combustion chamber by way of exhaust ports also disposed in the cylinder head. Valves are located within the ports of the cylinder head and seal against seats at the entrance of the ports to selectively allow and block the flow of air and exhaust.

Because of the proximity to the combustion process and/or due to friction within the engine, the cylinder head, cylinder liner, and other areas of the engine may be cooled in order to ensure proper and efficient operation of the engine. A cooling system is required to cool fluids directed into or out of the engine and generally includes a heat exchanger. An engine driven fan is disposed either in front of the engine/exchanger package to blow air across the exchanger and the engine, or between the engine and exchanger to blow air past the engine or suck air past the exchanger. In either configuration, a thermostat is located to selectively block the flow of coolant through the engine when the temperature of the engine is too low, and to allow the flow of coolant when the temperature of the engine exceeds a predetermined threshold. This thermostat is generally housed in its own dedicated housing, which can be mounted to the engine block or to the cylinder head. Before or after flowing through the engine, the coolant passes through the thermostat housing.

Although adequate for most situations, the separate thermostat housing can be problematic. Specifically, the separate housing consumes valuable space on the engine and is costly and time-consuming to produce and assemble. In addition, the separate housing introduces opportunities for leaks.

One attempt to solve the problems caused by having a separate thermostat housing is disclosed in U.S. Pat. No. 6,446,586 (the '586 patent) issued to Fukamachi on Sep. 10, 2002. The '586 patent discloses an adjoining engine block and a cylinder head, where both the engine block and the cylinder head have matching overhanging portions. A thermostat housing is fitted between the overhanging portion of the engine block and the overhanging portion of the cylinder head so that it projects from the engine body as little as possible. In this manner, the amount of space consumed by the separate thermostat housing may be minimized.

Although the thermostat housing arrangement of the '586 patent may minimize the amount of engine space consumed, it may still be a separate housing. Therefore, the thermostat housing may still be expensive to produce, time-consuming to assemble, and may provide leakage opportunities.

The present disclosure is directed to overcoming one or more of the shortcomings set forth above and/or other deficiencies in the art.

SUMMARY OF THE DISCLOSURE

In one aspect, the present disclosure is directed to a thermostat assembly for a combustion engine having at least one cylinder. The assembly includes a cylinder head configured to cap off the at least one cylinder. The cylinder head has a recess fluidly connected to a coolant passage of the combustion engine. The assembly also includes a thermostat located completely within the recess.

In another aspect, the present disclosure is directed toward a method for cooling a combustion engine. The method includes pressurizing a coolant, passing the pressurized coolant to a cylinder head of a combustion engine, and selectively restricting the flow of coolant at a location completely within the cylinder head based on a temperature of the combustion engine.

DETAILED DESCRIPTION

Figure 1:
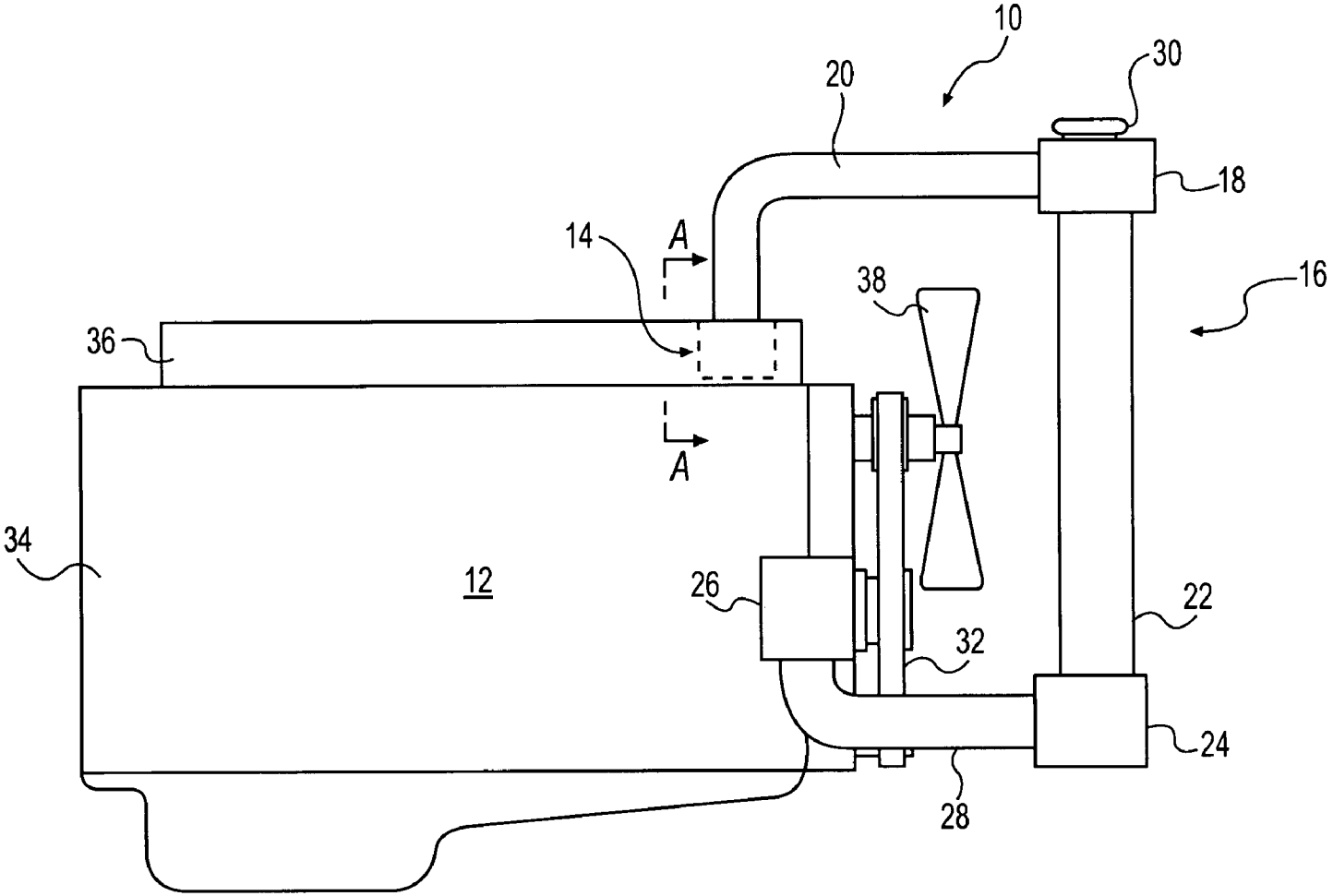
FIG. 1 is a diagrammatic illustration of an exemplary disclosed engine.

FIG. 1 illustrates an exemplary disclosed engine 12 that may produce a mechanical power output. Engine 12 may be an internal combustion engine such as, for example, a diesel engine, a gasoline engine, a gaseous fuel-powered engine, or any other type of engine apparent to one skilled in the art. Engine 12 may include an engine block 34 that at least partially defines a plurality of cylinders 21 (only one shown in FIG. 2). Engine 12 may also include a piston (not shown) slidably disposed within each cylinder, and a crankshaft (not shown) that is rotatably supported within engine block 34 by way of a plurality of journal bearings (not shown). A connecting rod (not shown) may connect each piston to the crankshaft so that a sliding motion of the pistons within each respective cylinder results in a rotation of the crankshaft. A cylinder head 36 may be attached to a top of engine block 34, so that a combustion chamber 23 (shown in FIG. 2) may be formed between a bottom of cylinder head 36, interior walls of cylinder 21, and a top or crown of the piston.

During its operation, engine 12 may produce heat from the combustion of fuel and air within cylinder 21. To dissipate this heat, engine 12 may include a cooling system 10. Cooling system 10 may help absorb the heat from engine 12 by directing a coolant through engine 12 and then dissipate this heat to the surrounding environment via a heat exchanger or radiator 16. Radiator 16 may include a top tank 18, a core 22, and a bottom tank 24. Top tank 18 may serve to receive the coolant, which may be any suitable coolant known in the art such as, for example, a mixture of water and ethylene glycol (i.e. antifreeze). Top tank 18 may include a filling neck 30 that may provide an opening for coolant to be added to cooling system 10. Filling neck 30 may include a cap for sealing neck 30.

Top tank 18 may be fluidly connected to core 22. Core 22 may operate to expel heat from cooling system 10 as coolant flows through core 22. Core 22 may be made from any suitable material known in the art, including aluminum or copper. Core 22 may include numerous flattened tubes (not shown)

configured in a parallel arrangement, through which coolant may flow. As the coolant comes into contact with the interior surface of the tubes, heat may be released from the coolant into the tubes and, subsequently, to ambient air or another heat-transferring medium. Each tube may include obstructions that make the coolant flow turbulent, causing more volume of the coolant to touch the interior surface of the tubes and increasing the rate of heat transfer. Core 22 may work in conjunction with a fan 38, which may be driven directly or indirectly by engine 12. In one embodiment, fan 38 may blow or draw ambient air across core 22, which may further increase the rate of heat transfer from the coolant flowing through the tubes to the ambient air.

Core 22 may be fluidly connected to bottom tank 24. Bottom tank 24 may be fluidly connected to a pump 26 by way of a pipe or hose 28. Pump 26 may be mounted to engine 12 and driven by engine 12 via a fan belt 32. Pump 26 may be an impeller type pump including a shaft (not shown) that is rotated by fan belt 32. The shaft may be connected to an impeller, where fan belt 32 causes both the shaft and impeller to rotate within a housing. The impeller may include curved blades that pressurize and push fluid as the impeller rotates, thereby pumping coolant through cooling system 10.

Engine block 34 and/or cylinder head 36 may include one or more coolant passages 39 (two shown in FIG. 2) that are fluidly connected to pump 26. Therefore, pump 26 may serve to pump coolant through engine block 34 and/or cylinder head 36 via coolant passages 39 to remove heat caused by engine combustion and/or friction. As the coolant passes through engine block 34 and/or cylinder head 36, heat may be transferred to the coolant of cooling system 10. A thermostat assembly 14 may be located to selectively restrict the flow of coolant through coolant passages 39.

Figure 2:
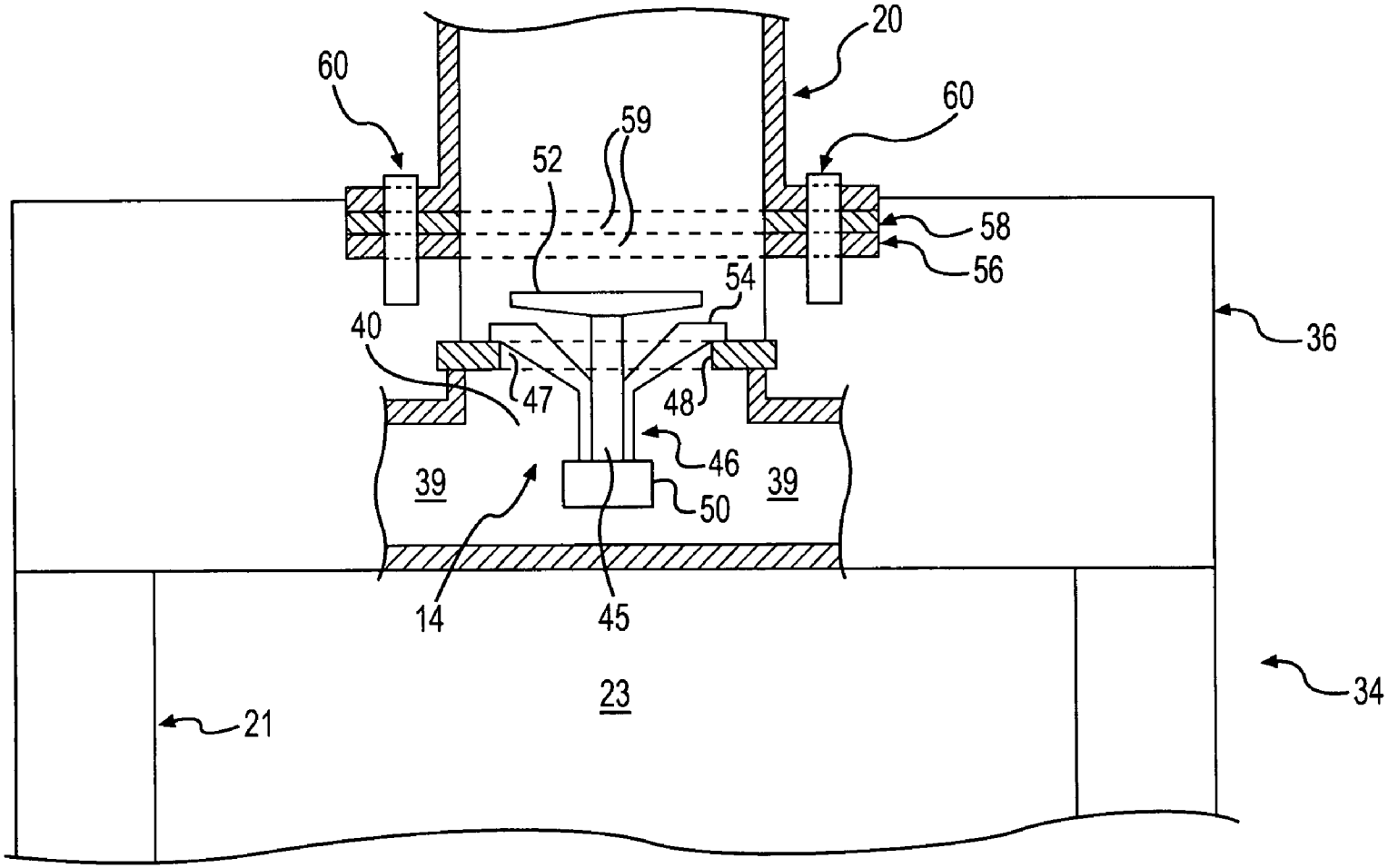
FIG. 2 is a cross-section of the engine of FIG. 1, taken through A-A.

Referring to FIG. 2, thermostat assembly 14 may be formed integrally into cylinder head 36, so that a recess 40 in cylinder head 36 may serve as a housing for thermostat assembly 14. Thermostat assembly 14 may be located completely within recess 40. Recess 40 may be divided by a wall 48, which may be mounted into cylinder head 36 by any suitable technique known in the art such as, for example, by welding. Wall 48 may include an aperture 47 through which coolant may pass. A thermostat 46 may be mounted within aperture 47 of wall 48.

Thermostat 46 may include a thermally sensitive element 50. Thermally sensitive element 50 may include a thermally sensitive material such as, for example, wax. Element 50 may be connected to a structural member 45, where member 45 supports a valve element 52. Valve element 52 may seal against a stationary conical seat 54. Structural member 45 may be slidable relative to conical seat 54. The thermally sensitive material of element 50 may be attached to structural member 45. The thermally sensitive material may expand and contract based on the temperature of coolant within recess 40, causing structural member 45 and valve element 52 to move up or down in relation to conical seat 54 (i.e., into and out of engagement with conical seat 54).

Thermostat assembly 14 may serve to selectively block the flow of coolant from engine block 34 and cylinder head 36 to or from top tank 18 when the temperature of the engine is too low, and to allow the flow of coolant when the temperature of the engine exceeds a given threshold. Coolant may enter recess 40 from coolant passages 39 or, alternatively, from top tank 18. When the temperature of coolant entering recess 40 is low, the thermally sensitive material of element 50 may contract, causing member 45 to move down and push valve element 52 against conical seat 54. This may effectively close aperture 47, thereby inhibiting coolant flow through thermostat assembly 14. When the temperature of coolant entering recess 40 is high, the thermally sensitive material of element 50 may expand, causing member 45 to move up and push valve element 52 away from conical seat 54. This may effectively open aperture 47, thereby allowing coolant flow through thermostat assembly 14.

Recess 40 may be fluidly connected to a hose 20, allowing coolant from coolant passages 39 to flow to or from top tank 18. Recess 40 may be partially closed off by a plate 58 having an aperture 59. Plate 58 may be attached to cylinder head 36 by fasteners 60. Plate 58 may be sealed against cylinder head 36 though a gasket 56, where gasket 56 may also include an aperture 59 and may be fastened to cylinder head 36 by common fasteners 60. Apertures 59 may be coaxial. Hose 20 may also be fastened to cylinder head 36 by fasteners 60. In an alternative embodiment, plate 58 may be omitted and hose 20 may be connected directly to cylinder head 36 and sealed by gasket 56. Coolant may flow from recess 40 through apertures 59 and into hose 20. Hose 20 may fluidly connect thermostat assembly 14 to top tank 18, completing a loop of cooling system 10.

INDUSTRIAL APPLICABILITY

The disclosed thermostat assembly may help to minimize the amount of engine space consumed by a thermostat, which may reduce costs of engine manufacturing. Also, the disclosed thermostat assembly may reduce the opportunity for leakage in an engine by making the thermostat housing integral with the cylinder head, thereby eliminating the requirement for extraneous fluid connections.

An operator may start engine 12, actuating fan belt 32 and causing pump 26 and fan 38 to begin operation. Pump 26 may pressurize a flow of coolant through coolant passages 39 in engine 12. Since significant heat may not yet be produced just after an ignition of engine 12, the coolant in coolant passages 39 may be relatively cool. Coolant may be pressurized by pump 26 and directed into recess 40. Since the coolant may be relatively cool at first, the thermally sensitive material of element 50 may contract or remain contracted. When the thermally sensitive material of element 50 contracts, structural member 45 and valve element 52 may move down, causing valve element 52 to seal against conical seat 54. This sealing may cause valve element 52 to block aperture 47 of wall 48, thereby preventing the flow of coolant through cooling system 10.

Engine 12 may continue to operate, causing heat to build up in engine block 34 and cylinder head 36. As heat builds in engine 12, the heat may transfer to the coolant in coolant passages 39. Heated coolant may flow into recess 40, causing the thermally sensitive material of element 50 to expand. As the thermally sensitive material of element 50 expands, structural member 45 and valve element 52 may move up away from conical seat 54, thereby opening aperture 47. Pump 26 may push the heated coolant through aperture 47, out of recess 40, and into hose 20. Pump 26 may pump the heated coolant through top tank 18 and into core 22 of radiator 16. Fan 38 may blow or draw ambient air across core 22, causing heat to transfer from the coolant to the air and effectively reducing the temperature of the coolant.

Pump 26 may force the cooled coolant into bottom tank 24 and through hose 28. The chilled coolant may be drawn from hose 28 and through pump 26, completing a loop of flow through cooling system 10. Pump 26 may pressurize the chilled coolant into coolant passages 39, where the heat of engine 12 may be transferred into the coolant. As the coolant is pumped through coolant passages 39, it may become heated. As the heated coolant reaches recess 40, it may cause the thermally sensitive material of element 50 to remain expanded, forcing structural member 45 and valve element 52 up and keeping aperture 47 open. Pump 26 may continue to pump the coolant through cooling system 10, repeating the cycle described above. The cycle may end when engine 12 is turned off, stopping the operation of pump 26 and the flow of coolant through cooling system 10. As the engine cools, valve element 52 may return to the closed position.

Thermostat assembly 14 may help to minimize the amount of space consumed within engine 12 by housing thermostat 46 within cylinder head 36. By locating thermostat 46 within cylinder head 36, the costs of engine manufacturing may also be reduced. Also, by housing thermostat assembly 14 within cylinder head 36, opportunities for leakage of coolant and other fluids may be reduced. That is, thermostat assembly 14 may reduce or even eliminate the requirement for an extraneous housing, thereby precluding possible leakage from additional fluid connections outside of engine 12.

It will be apparent to those skilled in the art that various modifications and variations can be made to the disclosed integral cylinder head and thermostat housing. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A thermostat assembly for a combustion engine having at least one cylinder, comprising:

a cylinder head configured to cap off the at least one cylinder, the cylinder head having a recess fluidly connected to a coolant passage of the combustion engine;

a plate configured to at least partially close off the recess; and a thermostat located completely within the recess and supported in the cylinder head only by a wall located within the recess.

2. The assembly of claim 1, further including a gasket located between the plate and the cylinder head.

3. The assembly of claim 2, wherein the plate and the gasket include coaxial apertures.

4. The assembly of claim 2, wherein the plate and gasket are attached to the cylinder head by a plurality of common fasteners.

5. The assembly of claim 4, wherein the thermostat is located downstream of the coolant passage.

6. The assembly of claim 1, wherein the thermostat includes a stationary conical seat member.

7. The assembly of claim 6, wherein the thermostat includes a valve configured to selectively seal against the stationary conical seat member.

8. The assembly of claim 7, wherein the stationary conical seat member is supported by the wall.

9. The assembly of claim 7, further including a thermally sensitive element connected to move the valve.

10. The assembly of claim 9, wherein the thermally sensitive element includes a wax member.

11. A method for cooling a combustion engine, comprising:

pressurizing a coolant;

passing the pressurized coolant to a cylinder head of the combustion engine, the cylinder head including a recess formed thereon, a thermostat positioned within the recess and supported in the cylinder head only by a wall located within the recess, and a plate configured to at least partially close off the recess; and selectively restricting the flow of coolant at the recess based on a temperature of the combustion engine.

12. The method of claim 11, further including cooling the pressurized coolant after the coolant passes through the cylinder head.

13. The method of claim 12, further including passing coolant that has been cooled to the combustion engine.

14. The method of claim 11, wherein selectively restricting includes thermally expanding a valve against a portion of the cylinder head to close off a passage.

15. An engine, comprising:

an engine block having at least one cylinder;

a cylinder head, having a top surface, configured to cap off the at least one cylinder, the cylinder head having a recess extending below the top surface and fluidly connected to a coolant passage of the engine block;

a plate configured to at least partially close off the recess, the plate being coupled to the cylinder head such that the plate is positioned substantially below the top surface of the cylinder head; and a thermostat located completely within the recess.

16. The engine of claim 15, further including a gasket located between the plate and the cylinder head.

17. The engine of claim 15, further including a conical seat operatively connected to a wall of the recess.

18. The engine of claim 15, wherein the thermostat includes a valve configured to selectively seal against the conical seat.

19. The engine of claim 18, wherein the thermostat includes a thermally sensitive element connected to the valve.

20. The engine of claim 19, wherein the thermally sensitive element includes a wax member.

21. A combustion engine having at least one cylinder, comprising:

a cooling system configured to circulate a cooling liquid through a cylinder head;

the cylinder head configured to cap off the at least one cylinder, the cylinder head including a recess extending from a top surface of the cylinder head to a coolant passage extending transversely with respect to the recess, the recess including a wall extending radially inwardly from a sidewall of the recess to form a centrally located aperture within the recess;

a hose attached to the cylinder head at the top surface and configured to transfer the cooling liquid between the coolant passage and the cooling system through the recess; and a thermostat positioned in the aperture and supported on the cylinder head only by the wall, the thermostat being configured to selectively allow the cooling liquid to flow through the aperture based on a temperature of the cooling liquid.

22. The combustion engine of claim 21, wherein the hose is removably attached to the cylinder head such that removal of the hose from the cylinder head does not remove the thermostat from the aperture.

23. The combustion engine of claim 21, further including a plate interconnecting the hose to the top surface of the cylinder head, the plate being positioned such that a top surface of the plate is positioned substantially below the top surface of the cylinder head.

* * * * *